US007156383B1

(12) United States Patent
Jacobs

(10) Patent No.: US 7,156,383 B1
(45) Date of Patent: Jan. 2, 2007

(54) INSTALLATION TOOL FOR INTERLOCKING GROOVED FLOORING PANELS

(76) Inventor: Charles A. Jacobs, P.O. Box 6077, Tampa, FL (US) 33608

( * ) Notice: Subject to any disclaimer, the term of this patent is extended or adjusted under 35 U.S.C. 154(b) by 0 days.

(21) Appl. No.: 11/339,408

(22) Filed: Jan. 26, 2006

(51) Int. Cl.
*B25B 1/00* (2006.01)

(52) U.S. Cl. ..... 269/17; 81/45; 254/11; 30/170

(58) Field of Classification Search ..... 269/17, 269/95, 904; 254/11; 81/45–46; 30/169–170
See application file for complete search history.

(56) References Cited

U.S. PATENT DOCUMENTS

| | | | | |
|---|---|---|---|---|
| 1,577,491 A | | 3/1926 | Prentice | |
| 2,588,401 A | | 3/1952 | Miller | |
| 2,710,166 A | | 6/1955 | Miller | |
| 4,699,430 A | * | 10/1987 | Nichols | 399/37.1 |
| 5,139,231 A | | 8/1992 | Temple | |
| D353,987 S | | 1/1995 | Pasto | |
| 5,527,014 A | | 6/1996 | Bracewell | |
| 5,921,155 A | * | 7/1999 | Faller et al. | 81/45 |
| 6,095,015 A | * | 8/2000 | Phelan | 81/45 |
| 6,711,971 B1 | * | 3/2004 | Morin | 81/45 |
| 2006/0191378 A1 | * | 8/2006 | Linscott | 81/45 |

* cited by examiner

*Primary Examiner*—Lee D Wilson

(57) ABSTRACT

A tool includes pivotally conjoined top and bottom planar bodies being coupled along their distal edges and having opposed linear ends. The bottom body is statically registered while the top body is dynamically articulatable. Slotted brackets are coupled to one linear end of the bodies, and are slidably interlocked and repeatedly moveable between compressed and engaged positions. Knobs traverse through the top body and are engaged therewith. The knobs are adaptable between raised and lowered positions. A turn wheel is connected to the knobs for raising and lowering the knobs in sync. A handle assembly includes wheels that are seated proximal to the bodies. A lever protrudes proximally from the wheels. A mechanism is included for preventing laminate planks from sliding downwardly along the top body. Rotatable and equidistantly spaced rollers are axially oriented along the top body and are registered with corresponding ones of the knobs.

15 Claims, 6 Drawing Sheets

INSTALLATION TOOL FOR INTERLOCKING GROOVED FLOORING PANELS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to installation tools and, more particularly, to an installation tool for interlocking grooved flooring panels.

2. Prior Art

It is wide-spread, conventional practice to construct buildings of many types and sizes with board sub-floors fixed in diagonal or perpendicular traversing relation to the usual floor joists and to subsequently complete the desired finish floor by means of matched boards, generally edge tongued and grooved, laid over and secured to the sub-floor. A factor of consequence in the development of high quality finish floors is the close, intimate edge matching of adjacent boards for the elimination of open cracks and seams. The practical control of said factor is aggravated by irregularities and inequalities inevitably characterizing the boards to be matched as a consequence of warping, twisting, and inaccurate milling, hence pointing to the desirability of means employable during laying of the finish floor to pressure-urge and clamp together the edges of the successively-laid boards as the same are positioned upon and nailed to the sub-floor.

Recently, a new form of flooring has been introduced to the United States known in layman's terms as laminate flooring. Such flooring consists of a rigid floor covering with a surface layer consisting of one or more thin sheets of a fibrous material (usually paper), impregnated with aminoplastic thermosetting resins (usually melamine). These sheets are either pressed as such (HPL or CPL, Compact), and in the case of HPL or CPL bonded on a substrate, or in the case of DPL directly pressed on a substrate. The product is normally finished with a backing primarily used as a balancing material. One advantage that such laminate flooring has over conventional hardwood flooring is the elimination of the need to nail, or otherwise affix, the floor finish to the sub-floor. Thus, installation is both less expensive and more expedient than it is for conventional wood floors.

Although the reasons are not the same as they are for hardwood flooring, there is also a need for ensuring that the separate strips or panels of laminate flooring are packed together as tightly as possible during installation. Now, there are a number of prior art apparatuses that are effectively used with hardwood floors for applying pressure to a newly added panel of flooring prior to being affixed to a previously laid panel of flooring. Unfortunately, these apparatuses are not suitable in use with laminate flooring due to angle at which the separate panels must ideally be engaged to ensure a gap-free and tight fit therebetween.

Accordingly, a need remains for an installation tool for interlocking grooved flooring panels in order to overcome the above-noted shortcomings. The present invention satisfies such a need by providing an installation tool that is easy and convenient to use, durable and efficient in design, and greatly reduces the amount of time and labor that is necessary for installing laminate flooring. The angular surface of the present apparatus enables grooved laminated flooring strips of this configuration to be engaged at an optimal angle. This helps to prevent damage to the laminate flooring strips during installation and helps to ensure strong, secure joints between the individual pieces. The apparatus also enables a single person to successfully install this type of flooring, where usually more than one individual is needed.

BRIEF SUMMARY OF THE INVENTION

In view of the foregoing background, it is therefore an object of the present invention to provide an installation tool for interlocking grooved flooring panels. These and other objects, features, and advantages of the invention are provided by a hand-operable and portable tool for advantageously and effectively assisting an operator to quickly and securely interlock laminate strip panels together while simultaneously laying the laminate strip panels on a floor surface.

The tool includes pivotally conjoined top and bottom planar bodies directly coupled to each other along corresponding longitudinal distal edges thereof. Each of the top and bottom planar bodies has a centrally registered longitudinal axis and a pair of opposed linear ends registered orthogonal thereto. Such a bottom planar body is statically registered parallel to the floor surface while the top planar body is dynamically articulatable during operating conditions.

The top planar body preferably further includes a plurality of notches and a plurality of interlockable fingers extending laterally outward from one of the linear ends so that the operator can conveniently directly and statically connect additional ones of the tool at a side-by-side orientation during installation procedures. Such a top planar body may also include a plurality of foot plates that are directly attached to a proximal edge thereof. The foot plates traverse above the top planar body and terminate at a predetermined height that is suitable for receiving a foot of the operator thereon so that the top planar body can be articulated downwardly towards the bottom planar body.

A plurality of arcuately slotted brackets are directly and intermediately coupled to one of the linear ends of each of the top and bottom planar bodies respectively. Such brackets are slidably interlocked and are repeatedly moveable between compressed and engaged positions defined along an arcuate path when the top planar body is pivoted about a fulcrum axis defined along the distal edge thereof.

A plurality of adjustable knobs traverse through the top planar body and are directly engaged therewith. Such knobs are selectively adapted between raised and lowered positions and thereby movable along a linear path oriented perpendicular to the top planar body. The knobs are equidistantly spaced along a longitudinal length of the top planar body. A turn wheel is operably connected to the knobs such that the operator can conveniently and effectively raise and lower the knobs in sync when the turn wheel is rotated about a linear axis defined orthogonal to the linear path.

A handle assembly includes a plurality of wheels that are seated proximal to the top and bottom planar bodies. Such a handle assembly further includes an elongated lever protruding proximally from the wheels that is centrally aligned between the linear ends. The handle assembly may further include a pair of bottom arcuately shaped arms that extend upwardly and distally away from the wheels. Such arms are directly coupled to the top planar body for advantageously and conveniently assisting the operator to quickly and effectively raise and lower the top planar body while the bottom planar body remains stationary.

A mechanism is included for advantageously preventing a plurality of laminate planks from sliding downwardly and distally along the top planar body. Such a preventing mechanism is releasably controlled by the operator when the actuating handle (described herein below) is biased rearwardly of the top and bottom planar bodies such that selected ones of the planks can be guided off of the top planar body when the preventing mechanism is biased to a lowered position.

The preventing mechanism preferably includes an actuating lever that is pivotally anchored directly to the handle of the handle assembly. A flexible and elongated cord has a proximal end tethered to the actuating lever. An elongated stop plate has opposed end portions disposed adjacent to the linear ends. Such a stop plate is pivotally and directly coupled to the top planar body and is registered orthogonal to the cord. The stop plate is spaced from the bottom planar body. The cord further has a distal end directly connected to the stop plate in such a manner that the stop plate is effectively caused to pivot along a longitudinal edge thereof when the operator compresses and releases the actuating lever.

A plurality of rollers are axially oriented along the top planar body and are rotatable about an axis registered parallel to the longitudinal axis of the top planar body. Such rollers are equidistantly spaced apart and are registered with corresponding ones of the knobs for respectively and effectively guiding laminate planks downwardly along the top planar body during installation procedures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
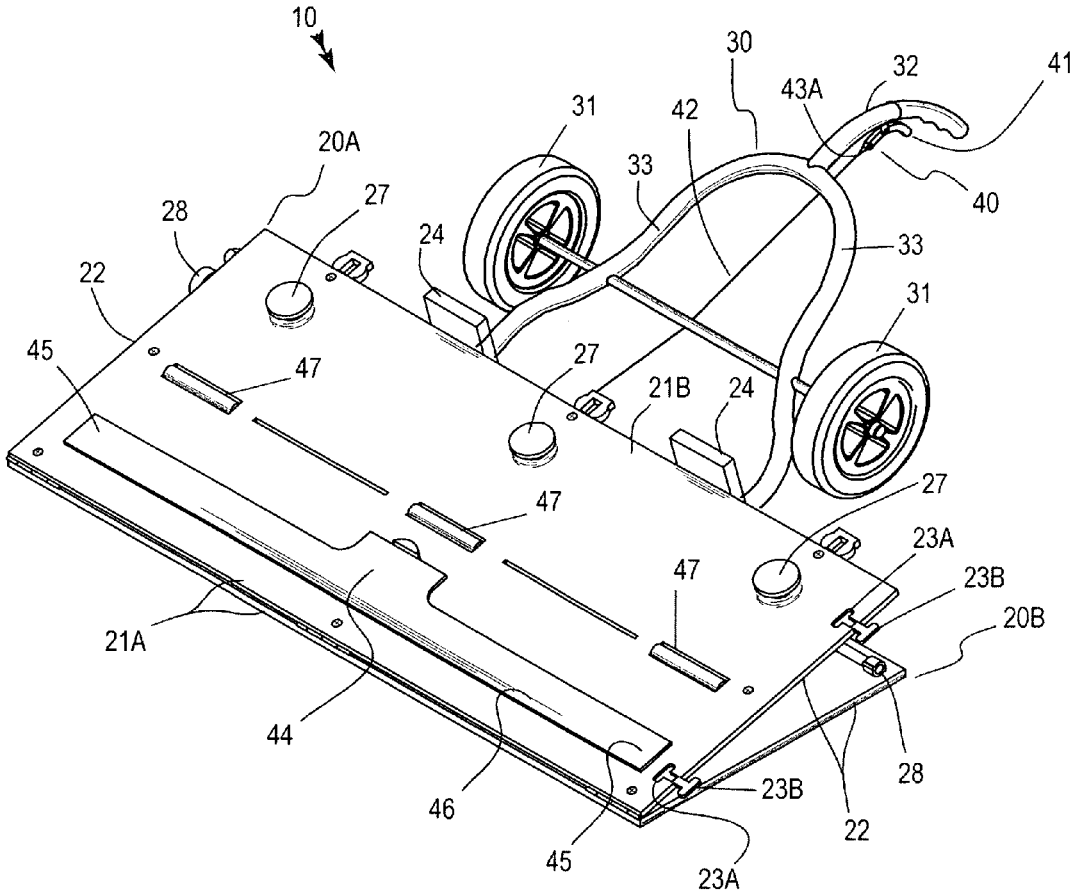
FIG. 1 is a perspective view showing an installation tool for interlocking grooved flooring panels, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refer to alternate embodiments of such elements.

The apparatus of this invention is referred to generally in FIGS. 1–8 by the reference numeral 10 and is intended to provide an installation tool for interlocking grooved flooring panels. It should be understood that the apparatus 10 may be used to install many different types of grooved flooring panels and should not be limited in use to only laminated type flooring panels.

Referring initially to FIGS. 1 through 6, the apparatus 10 includes pivotally conjoined top 20A and bottom 20B planar bodies directly coupled, without the use of intervening elements, to each other along corresponding longitudinal distal edges 21A thereof. Each of the top 20A and bottom 20B planar bodies has a centrally registered longitudinal axis and a pair of opposed linear ends 22 registered orthogonal thereto. Such a bottom planar body 20B is statically registered parallel to the floor surface while the top planar body 20A is dynamically articulatable during operating conditions. This is an essential feature for allowing a user to align the tongue portion of a new floor panel (not shown) with the groove of an already installed floor panel (not shown) at an optimal angle while simultaneously applying pressure to the new floor panel such that the tongue portion effectively engages the installed panel's groove without damaging the tongue portion.

Again referring to FIGS. 1 through 6, the top planar body 20A further includes a plurality of notches 23A and a plurality of interlockable fingers 23B that extend laterally outward from one 22A of the linear ends 22 so that the operator can conveniently directly and statically connect, without the use of intervening elements, additional ones of the apparatus 10 at a side-by-side orientation during installation procedures. This is an important and advantageous feature for effectively allowing the user to evenly distribute the pressure applied to a new floor panel along an entire longitudinal length of the floor panel so that the new panel engages the installed floor panel without leaving unsightly gaps therebetween.

Such a top planar body 20A also includes a plurality of foot plates 24 that are directly attached, without the use of intervening elements, to a proximal edge 21B thereof. The foot plates 24 traverses above the top planar body 20A and terminate at a predetermined height that is suitable for receiving a foot of the operator thereon so that the top planar body 20A can quickly, easily and conveniently be articulated downwardly towards the bottom planar body 20B at a desired angle.

Referring to FIGS. 2, 3, 5 and 6, a plurality of arcuately slotted brackets 25 are directly and intermediately coupled, without the use of intervening elements, to another one 22B of the linear ends 22 of each of the top 20A and bottom 20B planar bodies respectively. Such brackets 25 are slidably interlocked and are repeatedly moveable between compressed and engaged positions defined along an arcuate path when the top planar body 20A is pivoted about a fulcrum axis defined along the distal edge thereof. The slotted brackets 25 can advantageously be fixed at a static position by a wing-nut 26, thus effectively allowing the user to maintain an optimal angle between the top 20A and bottom 20B planar bodies once such an angle has been determined.

Referring to FIGS. 1 through 6, a plurality of adjustable knobs 27 traverse through the top planar body 20A and are directly engaged, without the use of intervening elements, therewith. Such knobs 27 are selectively adapted between raised and lowered positions and are thereby movable along a linear path oriented perpendicular to the top planar body 20A. The knobs 27 are equidistantly spaced along a longitudinal length of the top planar body 20A. A turn wheel 28 is operably connected to the knobs 27 such that the operator can conveniently and effectively raise and lower the knobs 27 in sync when the turn wheel 28 is rotated about a linear axis defined orthogonal to the linear path.

Figure 2:
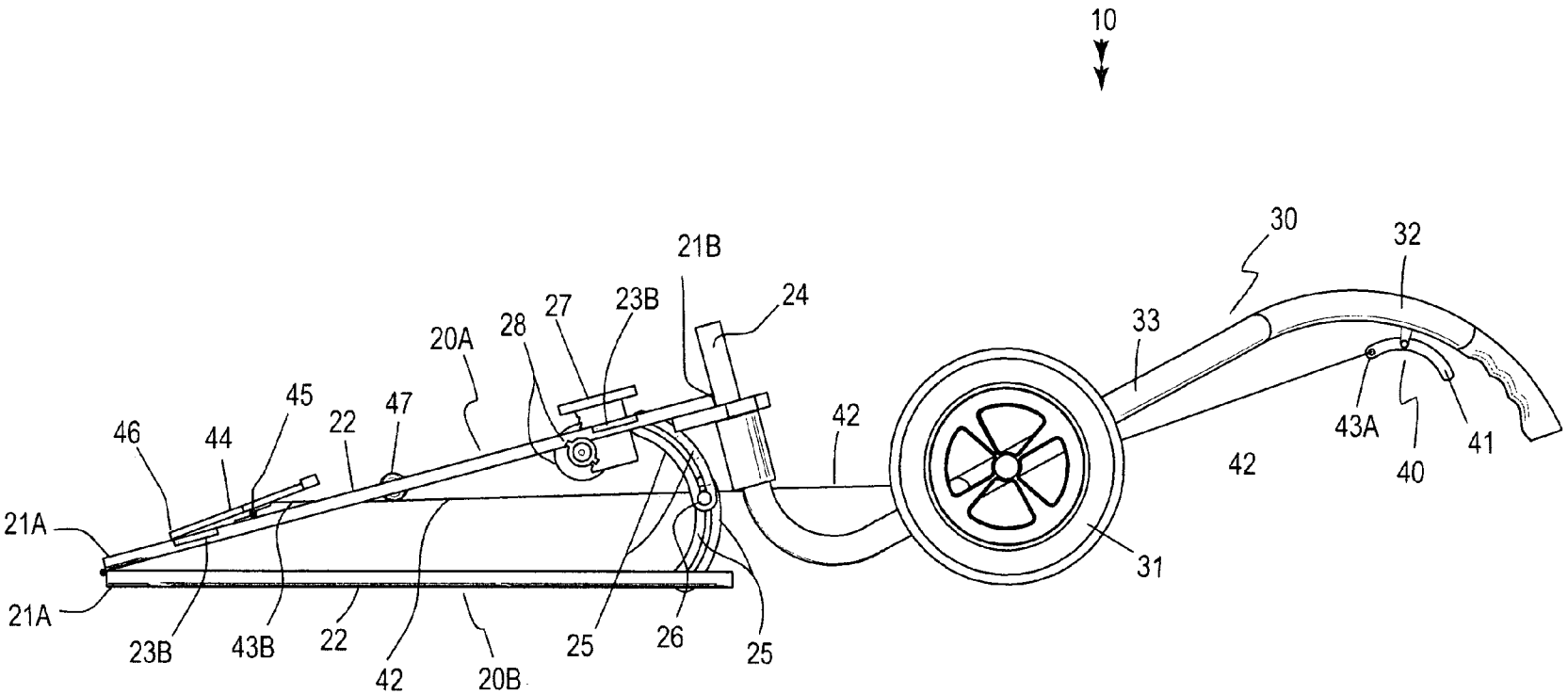
FIG. 2 is a side-elevational view of the apparatus shown in FIG. 1.
Figure 3:
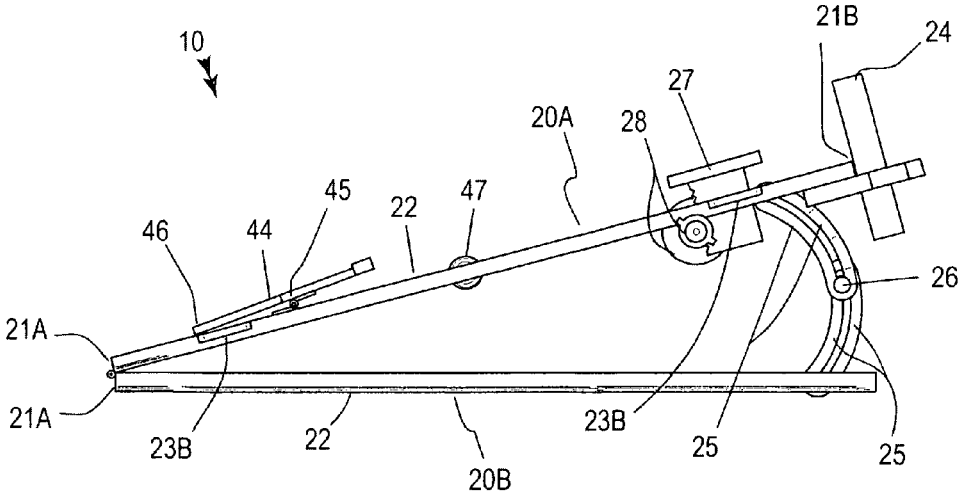
FIG. 3 is a side elevational view of the apparatus shown in FIG. 1, showing the handle assembly removed therefrom.
Figure 4:
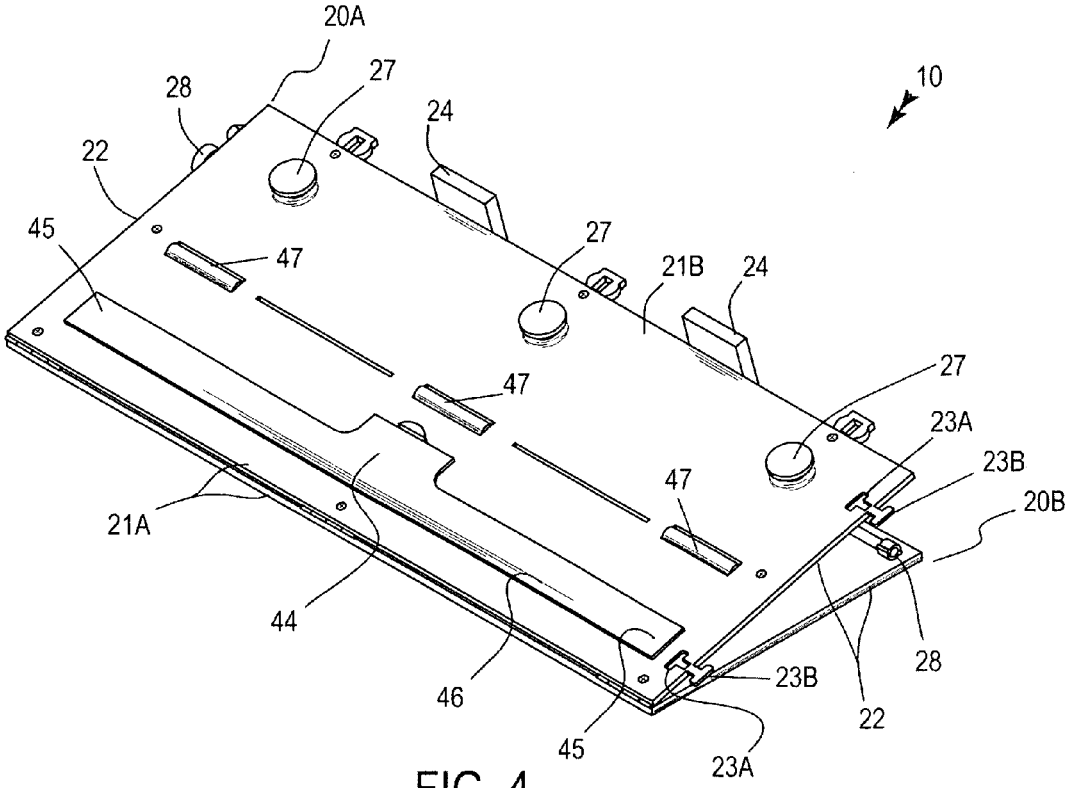
FIG. 4 is a perspective view of the top and bottom planar bodies shown in FIG. 3.
Figure 5:
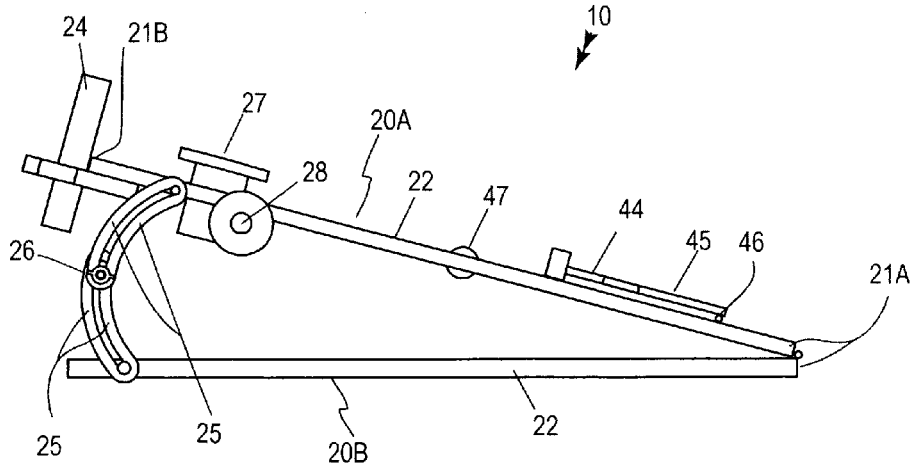
FIG. 5 is a left side-elevational view of the top and bottom planar bodies shown in FIG. 4.
Figure 6:
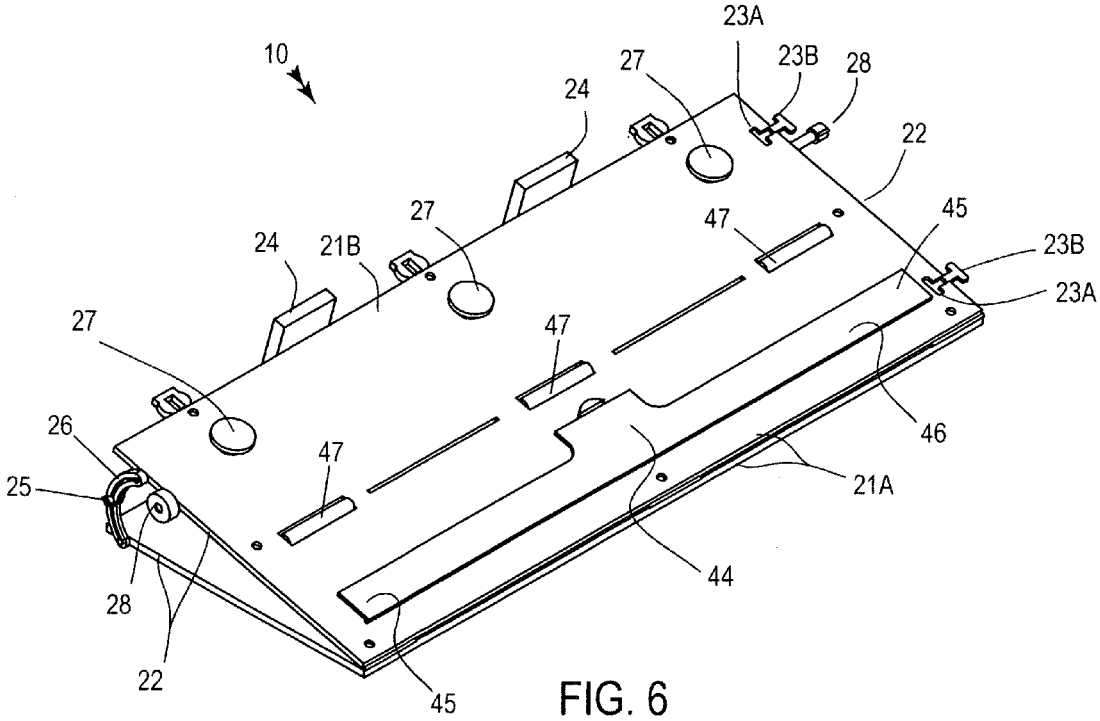
FIG. 6 is a perspective view of the top and bottom planar bodies shown in FIG. 5, showing the arcuately slotted brackets and the turn wheel.

Referring to FIGS. 1 and 2, a handle assembly 30 includes a plurality of wheels 31 that are seated proximal to the top 20A and bottom 20B planar bodies. The wheels 31 are important and advantageous for allowing a user to easily maneuver and transport the apparatus 10 between remote locations when floor panels are positioned upon the top planar body 20A. Such a handle assembly 30 further includes an elongated handle 32 protruding proximally from the wheels 31 that is centrally aligned between the linear ends 22. The handle assembly 30 also includes a pair of bottom arcuately shaped arms 33 that extend upwardly and distally away from the wheels 31. Such arms 33 are directly coupled, without the use of intervening elements, to the top planar body 20A, which is a vital and advantageous for conveniently assisting the operator to quickly and effectively raise and lower the top planar body 20A while the bottom planar body 20B remains stationary.

Referring to FIGS. 1 through 6, a mechanism 40 is included that is important for advantageously preventing a plurality of laminate planks (not shown) from sliding downwardly and distally along the top planar body 20A. Such a preventing mechanism 40 is releasably controlled by the operator when the actuating lever 41 (described herein below) is biased rearwardly of the top 20A and bottom 20B planar bodies such that selected ones of the planks can effectively be guided off of the top planar body 20A when the preventing mechanism is biased to a lowered position.

Still referring to FIGS. 1 through 6, the preventing mechanism 40 includes an actuating lever 41 that is pivotally anchored directly, without the use of intervening elements, to the handle 32 of the handle assembly 30. A flexible and elongated cord 42 has a proximal end 43A tethered to the actuating lever 41. An elongated stop plate 44 has opposed end portions 45 disposed adjacent to the linear ends 22. Such a stop plate 44 is pivotally and directly coupled, without the use of intervening elements, to the top planar body 20A and is registered orthogonal to the cord 42. The stop plate 44 is spaced from the bottom planar body 20A. The cord 42 further has a distal end 43B directly connected, without the use of intervening elements, to the stop plate 44 in such a manner that the stop plate 44 is effectively caused to pivot along a longitudinal edge 46 thereof when the operator compresses and releases the actuating lever 41.

Again referring to FIGS. 1 through 6, a plurality of rollers 47 are axially oriented along the top planar body 20A and are rotatable about an axis registered parallel to the longitudinal axis of the top planar body 20A. Such rollers 47 are equidistantly spaced apart and are registered with corresponding ones of the knobs 27, which is essential and convenient for respectively and effectively guiding laminate planks downwardly along the top planar body 20A during installation procedures.

Figure 7:
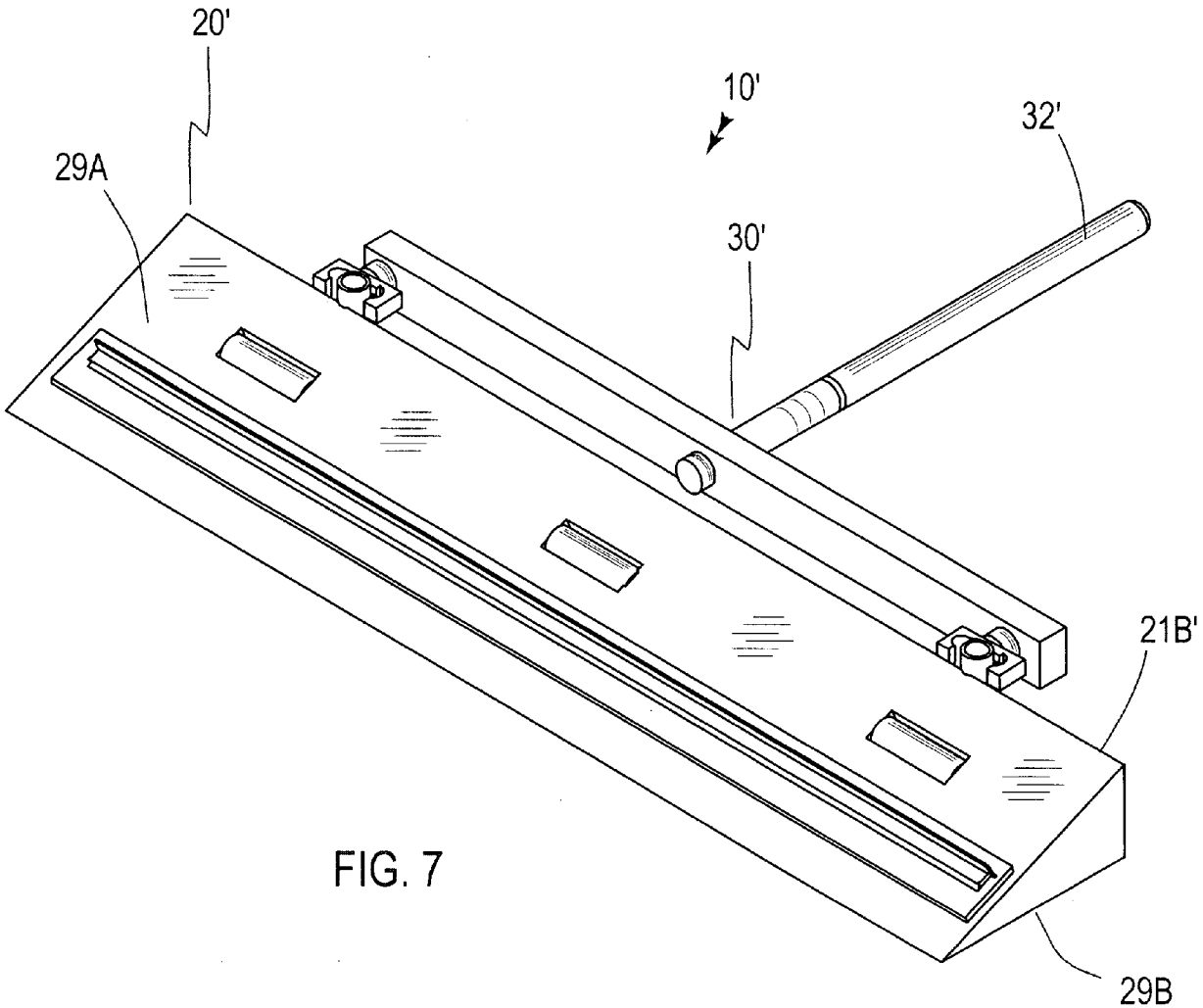
FIG. 7 is a perspective view showing an alternate embodiment of the installation tool for interlocking grooved flooring panels, in accordance with the present invention.
Figure 8:
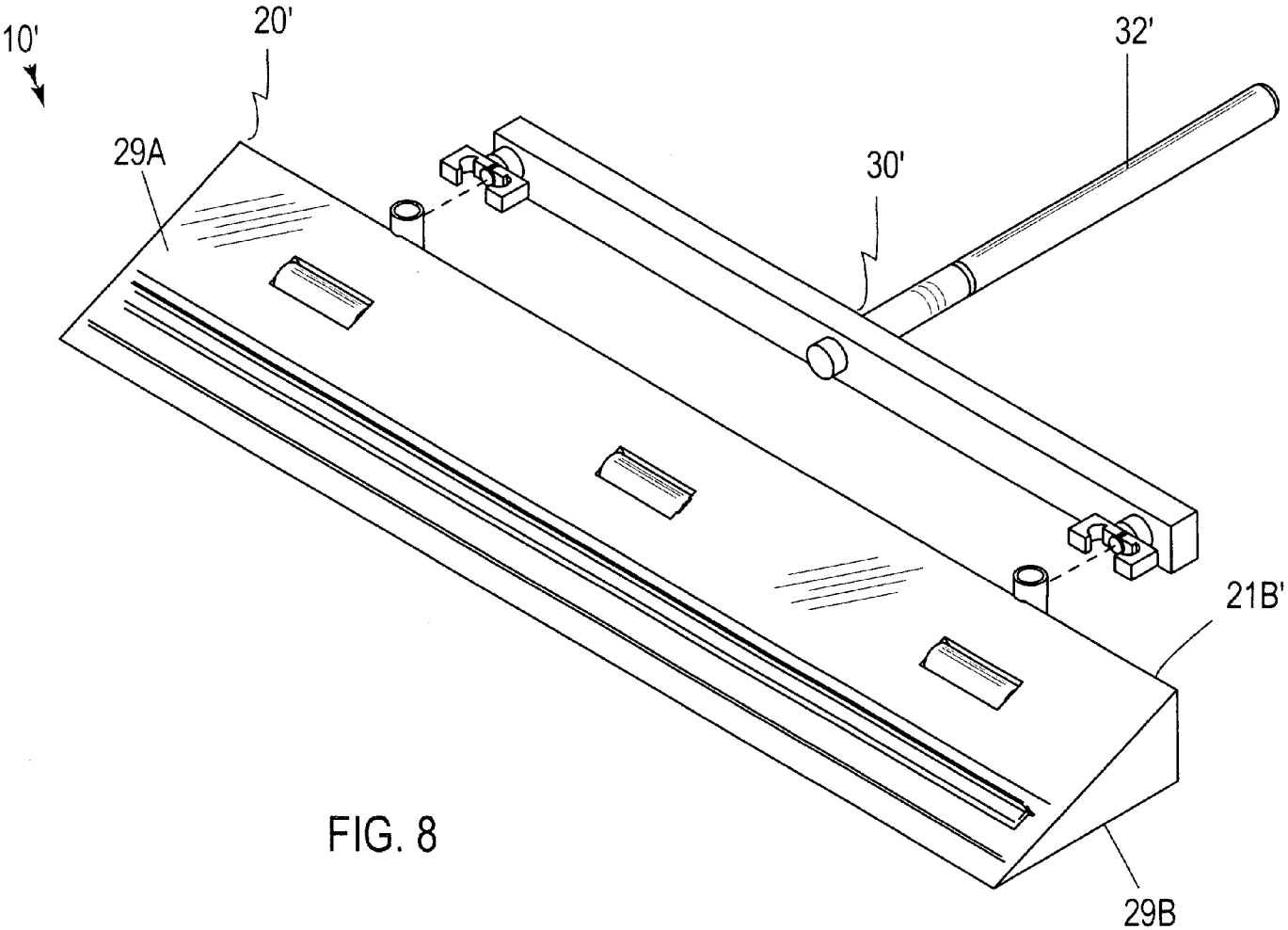
FIG. 8 is a partially exploded perspective view of the apparatus shown in FIG. 1.

Referring to FIGS. 7 and 8, in an alternate embodiment 10' the wedge shaped body 20' has a top surface 29A and a bottom surface 29B. A handle assembly 30' is included that has an elongated handle 32'. Such a handle assembly 30' is removably attached to the proximal end 21B' of the body 20', which is important for allowing a user to maneuver the apparatus 10' and to adjust the apparatus 10' to a more compact shape for easier storage and transport thereof.

In use, a trio or another suitable number of apparatuses 10 is positioned adjacent to the last installed floor panel. The new floor panel is then positioned upon the respective top planar body 20A of each apparatus 10 being used. The stop plate 44 is then progressively released so as to permit for the proper engagement of the tongue portion of the new panel with the groove of the installed panel. These steps can quickly and easily be repeated by one person until the entire floor surface of a selected room is covered in the user's floor panel of choice.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hand-operable and portable tool for assisting an operator to quickly and securely interlock laminate strip panels together while simultaneously laying the laminate strip panels on a floor surface, said tool comprising:

pivotally conjoined top and bottom planar bodies directly coupled to each other along corresponding longitudinal distal edges thereof, each of said top and bottom planar bodies having a centrally registered longitudinal axis and a pair of opposed linear ends registered orthogonal thereto, said bottom planar body being statically registered parallel to the floor surface while said top planar body is dynamically articulatable during operating conditions;

a plurality of arcuately slotted brackets directly and intermediately coupled to one of said linear ends of each of said top and bottom planar bodies respectively, said brackets being slidably interlocked and repeatedly moveable between compressed and engaged positions defined along an arcuate path when said top planar body is pivoted about a fulcrum axis defined along said distal edge thereof;

a plurality of adjustable knobs traversed through said top planar body and directly engaged therewith, said knobs being selectively adapted between raised and lowered positions and thereby movable along a linear path oriented perpendicular to said top planar body, said knobs being equidistantly spaced along a longitudinal length of said top planar body;

a turn wheel operably connected to said knobs such that the operator can raise and lower said knobs in sync when said turn wheel is rotated about a linear axis defined orthogonal to said linear path;

a handle assembly including a plurality of wheels seated proximal to said top and bottom planar bodies, said handle assembly further including an elongated lever protruding proximally from said wheels and being centrally aligned between said linear ends; and means for preventing a plurality of laminate planks from sliding downwardly and distally along said top planar body, said preventing means being releasably controlled by the operator when said handle assembly is biased rearwardly of said top and bottom planar bodies such that selected ones of the planks can be guided off of said top planar body when said preventing means is biased to a lowered position.

2. The apparatus of claim 1, wherein said handle assembly further comprises:

a pair of bottom arcuately shaped arms extending upwardly and distal away from said wheels, said arms being directly coupled to said top planar body for assisting the operator to quickly and effectively raise and lower said top planar body while said bottom planar body remains stationary.

3. The apparatus of claim 1, wherein said preventing means comprises:

an actuating lever pivotally anchored directly to said handle of said handle assembly;

a flexible and elongated cord having a proximal end tethered to said actuating lever; and an elongated stop plate having opposed end portions disposed adjacent to said linear ends, said stop plate being pivotally and directly coupled to said top planar body and registered orthogonal to said cord, said stop plate being spaced from said bottom planar body;

wherein said cord further has a distal end directly connected to said stop plate in such a manner that said stop plate is caused to pivot along a longitudinal edge thereof when the operator compresses and releases said actuating lever.

4. The apparatus of claim 1, wherein said top planar body further comprises:

a plurality of notches and a plurality of interlockable fingers extending laterally outward from one said linear ends so that the operator can directly and statically connect additional ones of said tool at a side-by-side orientation during installation procedures.

5. The apparatus of claim 1, wherein said top planar body further comprises:

a plurality of foot plates directly attached to a proximal edge thereof, said foot plates traversing above said top planar body and terminating at a predetermined height suitable for receiving a foot of the operator thereon so that said top planar body can be articulated downwardly towards said bottom planar body.

6. A hand-operable and portable tool for assisting an operator to quickly and securely interlock laminate strip panels together while simultaneously laying the laminate strip panels on a floor surface, said tool comprising:

pivotally conjoined top and bottom planar bodies directly coupled to each other along corresponding longitudinal distal edges thereof, each of said top and bottom planar bodies having a centrally registered longitudinal axis and a pair of opposed linear ends registered orthogonal thereto, said bottom planar body being statically registered parallel to the floor surface while said top planar body is dynamically articulatable during operating conditions, a plurality of rollers axially oriented along said top planar body and rotatable about an axis registered parallel to the longitudinal axis of said top planar body;

a plurality of arcuately slotted brackets directly and intermediately coupled to one of said linear ends of each of said top and bottom planar bodies respectively, said brackets being slidably interlocked and repeatedly moveable between compressed and engaged positions defined along an arcuate path when said top planar body is pivoted about a fulcrum axis defined along said distal edge thereof;

a plurality of adjustable knobs traversed through said top planar body and directly engaged therewith, said knobs being selectively adapted between raised and lowered positions and thereby movable along a linear path oriented perpendicular to said top planar body, said knobs being equidistantly spaced along a longitudinal length of said top planar body;

a turn wheel operably connected to said knobs such that the operator can raise and lower said knobs in sync when said turn wheel is rotated about a linear axis defined orthogonal to said linear path;

a handle assembly including a plurality of wheels seated proximal to said top and bottom planar bodies, said handle assembly further including an elongated lever protruding proximally from said wheels and being centrally aligned between said linear ends; and means for preventing a plurality of laminate planks from sliding downwardly and distally along said top planar body, said preventing means being releasably controlled by the operator when rearwardly of said top and bottom planar bodies such that selected ones of the planks can be guided off of said top planar body when said preventing means is biased to a lowered position.

7. The apparatus of claim 6, wherein said handle assembly further comprises:

a pair of bottom arcuately shaped arms extending upwardly and distal away from said wheels, said arms being directly coupled to said top planar body for assisting the operator to quickly and effectively raise and lower said top planar body while said bottom planar body remains stationary.

8. The apparatus of claim 6, wherein said preventing means comprises:

an actuating lever pivotally anchored directly to said handle of said handle assembly;

a flexible and elongated cord having a proximal end tethered to said actuating lever; and an elongated stop plate having opposed end portions disposed adjacent to said linear ends, said stop plate being pivotally and directly coupled to said top planar body and registered orthogonal to said cord, said stop plate being spaced from said bottom planar body;

wherein said cord further has a distal end directly connected to said stop plate in such a manner that said stop plate is caused to pivot along a longitudinal edge thereof when the operator compresses and releases said actuating lever.

9. The apparatus of claim 6, wherein said top planar body further comprises:

a plurality of notches and a plurality of interlockable fingers extending laterally outward from one said linear ends so that the operator can directly and statically connect additional ones of said tool at a side-by-side orientation during installation procedures.

10. The apparatus of claim 6, wherein said top planar body further comprises:

a plurality of foot plates directly attached to a proximal edge thereof, said foot plates traversing above said top planar body and terminating at a predetermined height suitable for receiving a foot of the operator thereon so that said top planar body can be articulated downwardly towards said bottom planar body.

11. A hand-operable and portable tool for assisting an operator to quickly and securely interlock laminate strip panels together while simultaneously laying the laminate strip panels on a floor surface, said tool comprising:

pivotally conjoined top and bottom planar bodies directly coupled to each other along corresponding longitudinal distal edges thereof, each of said top and bottom planar bodies having a centrally registered longitudinal axis and a pair of opposed linear ends registered orthogonal thereto, said bottom planar body being statically registered parallel to the floor surface while said top planar body is dynamically articulatable during operating conditions;

a plurality of arcuately slotted brackets directly and intermediately coupled to one of said linear ends of each of said top and bottom planar bodies respectively, said brackets being slidably interlocked and repeatedly moveable between compressed and engaged positions defined along an arcuate path when said top planar body is pivoted about a fulcrum axis defined along said distal edge thereof;

a plurality of adjustable knobs traversed through said top planar body and directly engaged therewith, said knobs being selectively adapted between raised and lowered positions and thereby movable along a linear path oriented perpendicular to said top planar body, said knobs being equidistantly spaced along a longitudinal length of said top planar body;

a turn wheel operably connected to said knobs such that the operator can raise and lower said knobs in sync when said turn wheel is rotated about a linear axis defined orthogonal to said linear path;

a handle assembly including a plurality of wheels seated proximal to said top and bottom planar bodies, said handle assembly further including an elongated lever protruding proximally from said wheels and being centrally aligned between said linear ends;

means for preventing a plurality of laminate planks from sliding downwardly and distally along said top planar body, said preventing means being releasably controlled by the operator when rearwardly of said top and bottom planar bodies such that selected ones of the planks can be guided off of said top planar body when said preventing means is biased to a lowered position; and a plurality of rollers axially oriented along said top planar body and rotatable about an axis registered parallel to the longitudinal axis of said top planar body, wherein said rollers are equidistantly spaced apart and registered with corresponding ones of said knobs for respectively guiding laminate planks downwardly along said top planar body during installation procedures.

12. The apparatus of claim 11, wherein said handle assembly further comprises:

a pair of bottom arcuately shaped arms extending upwardly and distal away from said wheels, said arms being directly coupled to said top planar body for assisting the operator to quickly and effectively raise and lower said top planar body while said bottom planar body remains stationary.

13. The apparatus of claim 11, wherein said preventing means comprises:

an actuating lever pivotally anchored directly to said handle of said handle assembly;

a flexible and elongated cord having a proximal end tethered to said actuating lever; and an elongated stop plate having opposed end portions disposed adjacent to said linear ends, said stop plate being pivotally and directly coupled to said top planar body and registered orthogonal to said cord, said stop plate being spaced from said bottom planar body;

wherein said cord further has a distal end directly connected to said stop plate in such a manner that said stop plate is caused to pivot along a longitudinal edge thereof when the operator compresses and releases said actuating lever.

14. The apparatus of claim 11, wherein said top planar body further comprises:

a plurality of notches and a plurality of interlockable fingers extending laterally outward from one said linear ends so that the operator can directly and statically connect additional ones of said tool at a side-by-side orientation during installation procedures.

15. The apparatus of claim 11, wherein said top planar body further comprises:

a plurality of foot plates directly attached to a proximal edge thereof, said foot plates traversing above said top planar body and terminating at a predetermined height suitable for receiving a foot of the operator thereon so that said top planar body can be articulated downwardly towards said bottom planar body.

* * * * *